US005732867A

United States Patent [19]

Perkins et al.

[11] Patent Number: 5,732,867

[45] Date of Patent: Mar. 31, 1998

[54] RELEASABLE BACKPACK

[75] Inventors: Richard W. Perkins; Joseph A. Kempton, both of Van Nuys, Calif.

[73] Assignee: Crush Innovative Sports Systems, Inc., Los Alamitos, Calif.

[21] Appl. No.: 756,563

[22] Filed: Nov. 26, 1996

[51] Int. Cl.[6] ..... A45F 3/10

[52] U.S. Cl. ..... 224/628; 224/634; 224/271

[58] Field of Search ..... 224/628, 633, 224/634, 242, 271, 272

[56] References Cited

U.S. PATENT DOCUMENTS

| | | | |
|---|---|---|---|
| 2,990,089 | 6/1961 | Nystrom | 224/628 |
| 4,223,819 | 9/1980 | Wright | 224/628 X |
| 4,307,826 | 12/1981 | Stewart | 224/634 |
| 4,572,414 | 2/1986 | Blatt | 224/633 |

*Primary Examiner*—Renee S. Luebke

*Attorney, Agent, or Firm*—Blakely, Sokoloff, Taylor & Zafman

[57] ABSTRACT

The backpack includes a pin that extends from a first frame. The first frame supports a bag or equipment that is carried by an end user. The backpack also includes a second frame that is worn by the end user. The second frame has a spring biased lock rod that moves between a lock position and a release position. In the lock position the rod engages the pin and attaches the first frame to the second frame. The lock rod is attached to a cord which can be pulled to move the rod to the release position. To release the backpack, the end user pulls the cord to disengage the lock rod from the pin. The pin is then separated from the rod to release the first frame from the second frame. The backpack can be re-attached by inserting the pin with the spring biased lock rod.

15 Claims, 5 Drawing Sheets

RELEASABLE BACKPACK

BACKGROUND OF THE INVENTION

1. Field of the Invention

The present invention relates to a releasable backpack.

2. Description of Related Art

Soldiers typically utilize a backpack to carry equipment and other gear. The backpacks have a pair of shoulder straps and a waist strap that secure the pack to the soldier. When in combat it is sometimes desirable to remove the backpack to reduce the weight carried by the soldier. The soldier must manipulate out of the straps to remove the pack. Disengaging from the straps is a two-handed, time consuming procedure that prevents the soldier from engaging in combat activity. It would be desirable to provide a backpack that can be quickly detached from a soldier.

SUMMARY OF THE INVENTION

The present invention is a releasable backpack. The backpack includes a pin that extends from a first frame. The first frame supports a bag or equipment that is carried by an end user. The backpack also includes a second frame that is worn by the end user. The second frame has a spring biased lock rod that moves between a lock position and a release position. In the lock position the rod engages the pin and attaches the first frame to the second frame. The lock rod is attached to a cord which can be pulled to move the rod to the release position. To release the backpack, the end user pulls the cord to disengage the lock rod from the pin. The pin is then separated from the rod to release the first frame from the second frame. The backpack can be re-attached by inserting the pin into the spring biased lock rod.

DETAILED DESCRIPTION OF THE INVENTION

Figure 1:
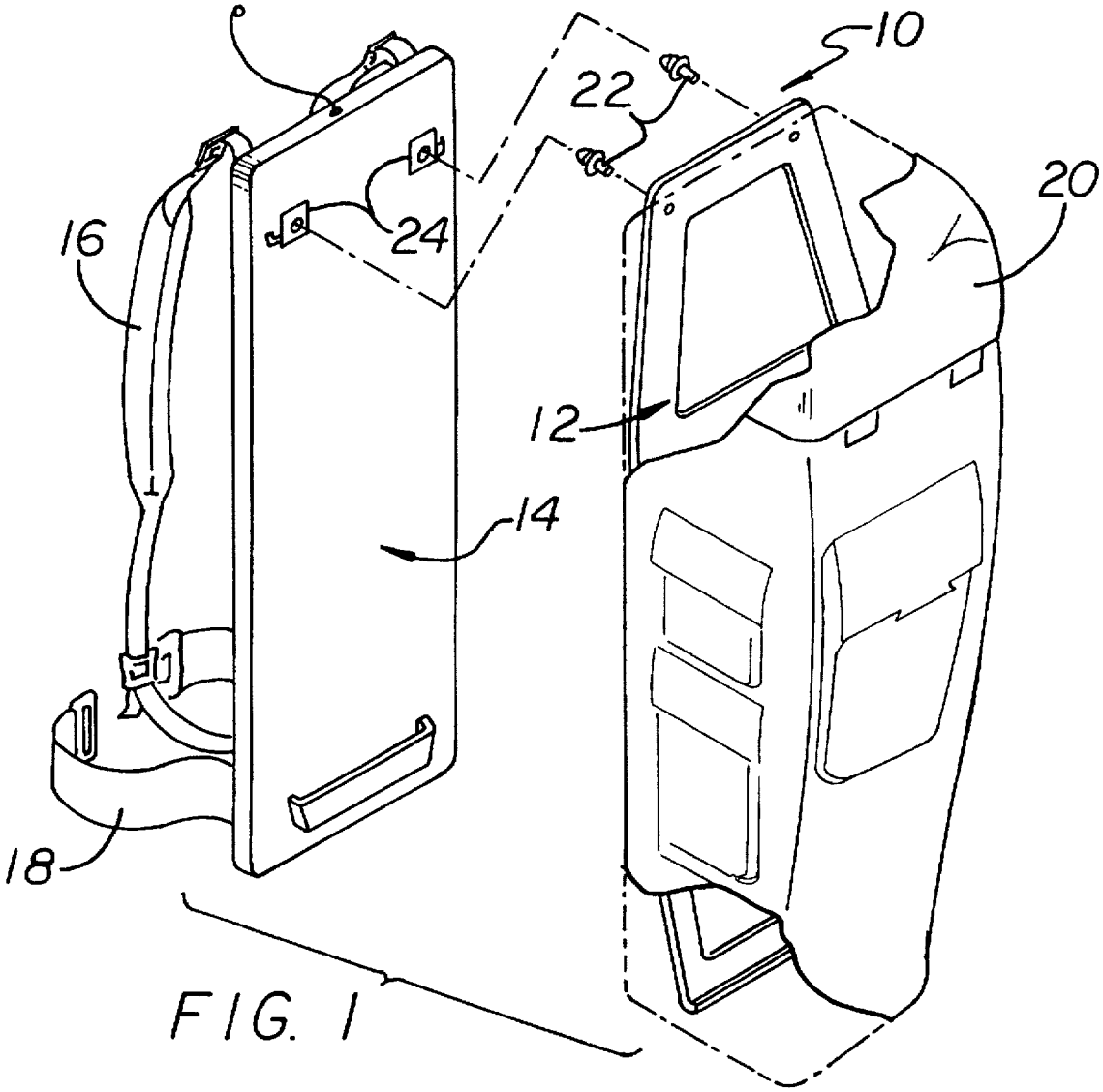
FIG. 1 is a perspective view of a backpack of the present invention.

Referring to the drawings more particularly by reference numbers, FIG. 1 shows a backpack 10 of the present invention. The backpack 10 includes a first frame 12 that can be releasably attached to a second frame 14. The second frame 14 typically has a pair of shoulder straps 16 that can be donned by an end user. The frame 14 can be secured to the user by a waist strap 18.

The first frame 12 may support a bag 20 that can carry various items. As an alternate embodiment, the first frame 12 may support an electronic assembly, or any other device that is mounted directly to the frame 12. Extending from the first frame 12 are a pair of pins 22. The pins 22 are inserted into apertures 24 of the second frame 14.

Figure 2:
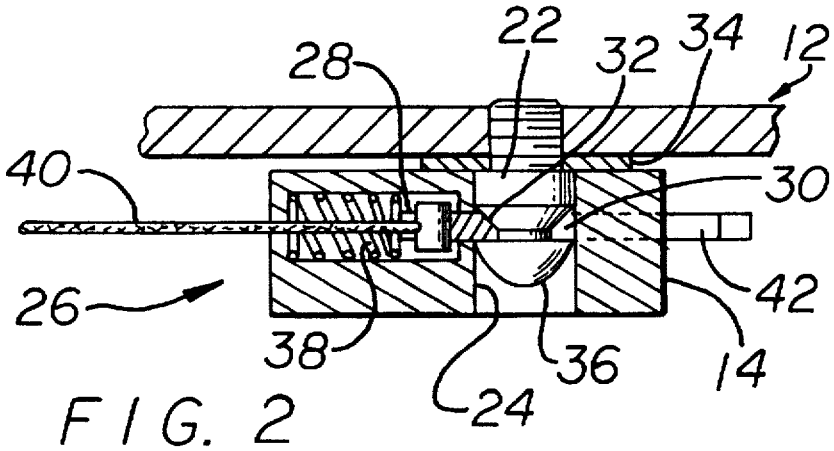
FIG. 2 is a side sectional view of a latching mechanism of the backpack.
Figure 3:
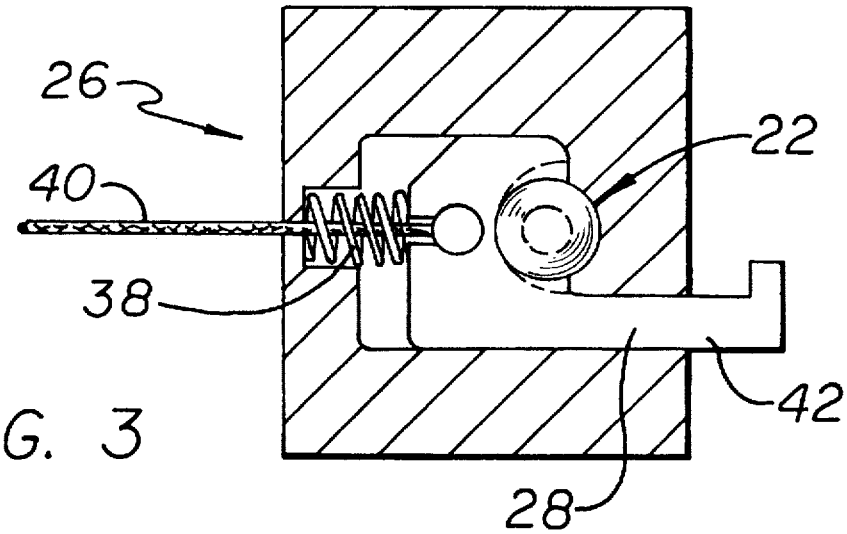
FIG. 3 is a top sectional view of the latching mechanism shown in FIG. 2.

As shown in FIGS. 2 and 3, the second frame 14 contains a latching mechanism 26 that secures the pins 22 of the first frame 12. There is a mechanism 26 for each aperture 24 in the second frame 14. The mechanism 26 includes a latch rod 28 that moves between a latch position and a release position.

As shown in FIGS. 2 and 3, when in the lever position the lever rod 28 engages the pin 22 and attaches the first frame 12 to the second frame 14. In the preferred embodiment, each pin 22 has an annular groove 30 which receives a chamfered surface 32 of a lever rod 28. Each pin 22 may have a stop washer 34 which limits the insertion depth of the pin 22 and aligns the groove 30 with the rod 28. Each pin 22 may also have an outer conical shaped bearing surface 36 that engages and pushes the lever rod 28 to the release position when the pin 22 is inserted into the aperture 24.

Each mechanism 26 includes a spring 38 that biases the lever rod 28 into the lock position. The lock rod 28 is also connected to a release cord 40 that extends from the second frame 14. The cord 40 can be pulled by an end user to move the lever rod 28 to the release position and disengage the rod 28 from the pin 22. The lever rod 28 may also have a lever 42 that can be pushed by the end user to move the rod 28 to the release position. The lever 42 may provide a back-up mechanism, in the event the cord 40 becomes inoperative.

Figure 4:
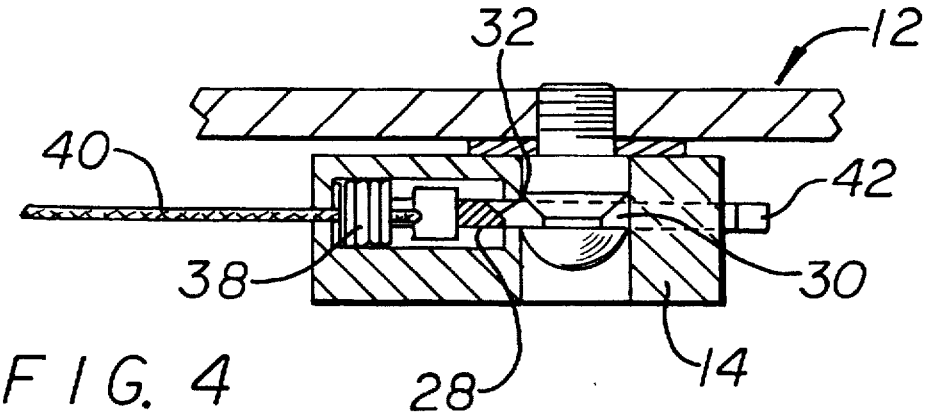
FIG. 4 is a side sectional view of the locking mechanism in a release position.
Figure 5:
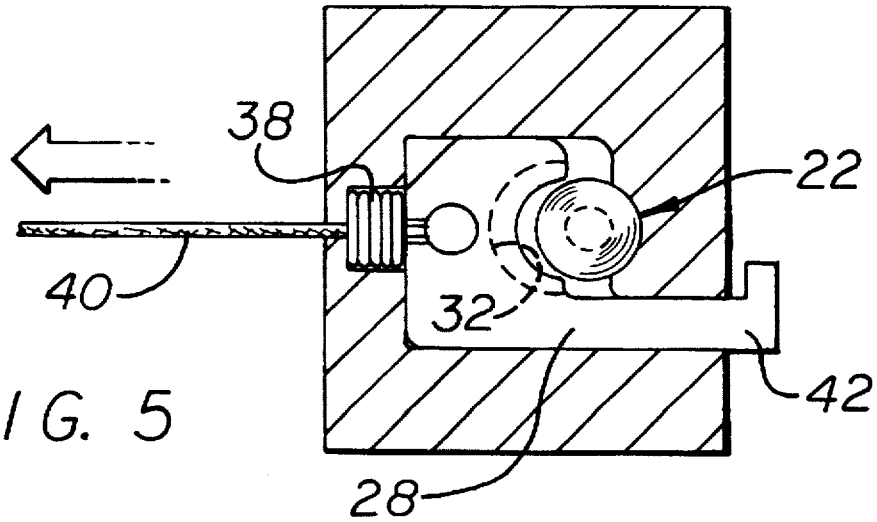
FIG. 5 s a top sectional view of the locking mechanism shown in FIG. 4.

As shown in FIGS. 4 and 5, the backpack 10 can be released by pulling the cord 40 and moving the latch rods 28 to the release positions. The rods 28 become disengaged from the pins 22 so that the first frame 12 can be pulled away from the second frame 14. When the pins 22 are pulled out of the apertures 26 and the cord 40 is released, the springs 38 push the latch rods 28 back to the original position.

Figure 6:
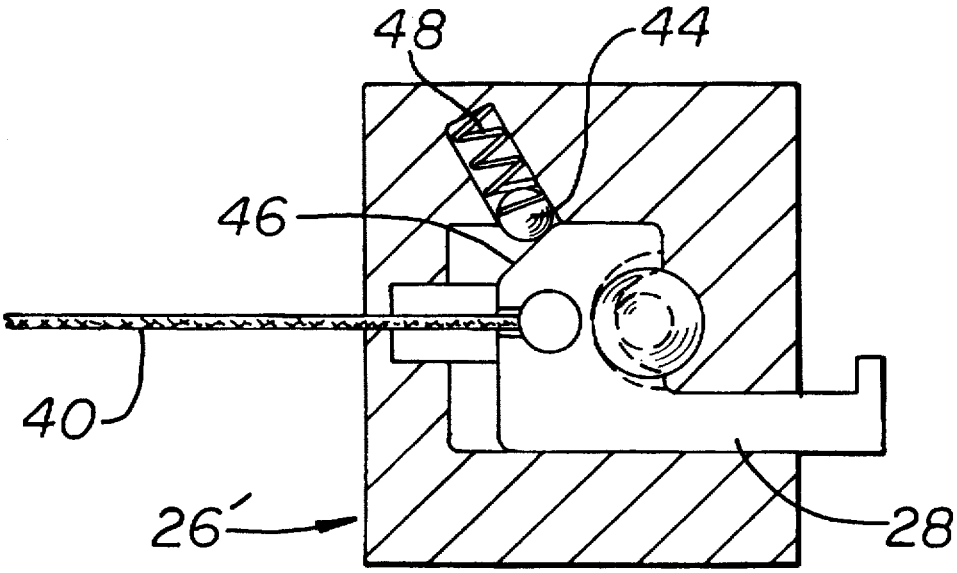
FIG. 6 is a top sectional view of an alternate embodiment of the latching mechanism in an extended position.

FIG. 6 shows an alternate embodiment of a locking mechanism 26' which has a ball 44 that is biased into a chamfered surface 46 of the latch rod 28 by a spring 48. The mechanism 26' does not have the spring 38 shown in FIG. 3.

Figure 7:
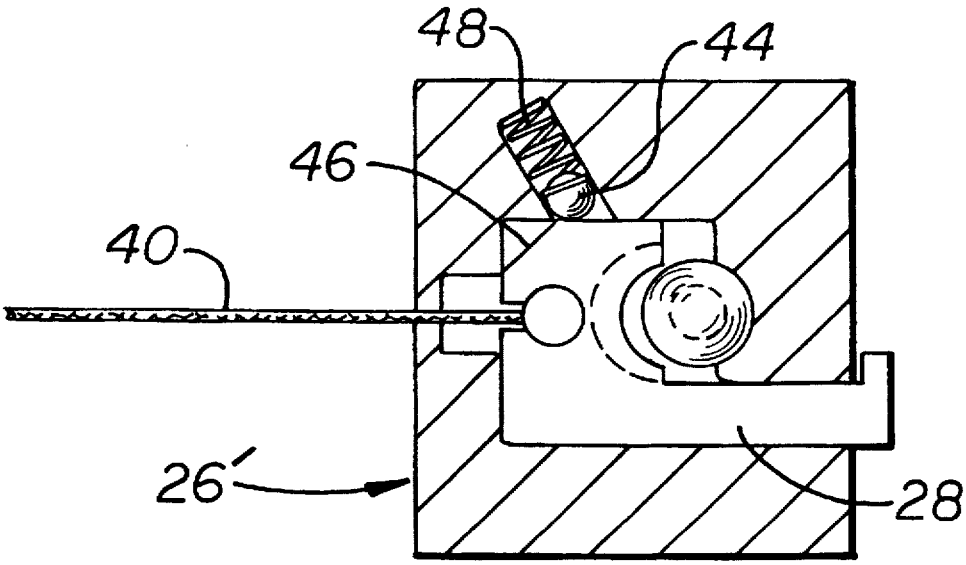
FIG. 7 is a top sectional view showing the latching mechanism of FIG. 6 in a release position.

As shown in FIG. 7, when the lock rod 28 is pulled to an extended position the ball 44 moves beyond the chamfered surface 46 so that the spring 48 does not push the rod 28 back to the original position. This allows the end user to detach the first frame 12 from the second frame 14 without continually pulling the cord 40.

Figure 8:
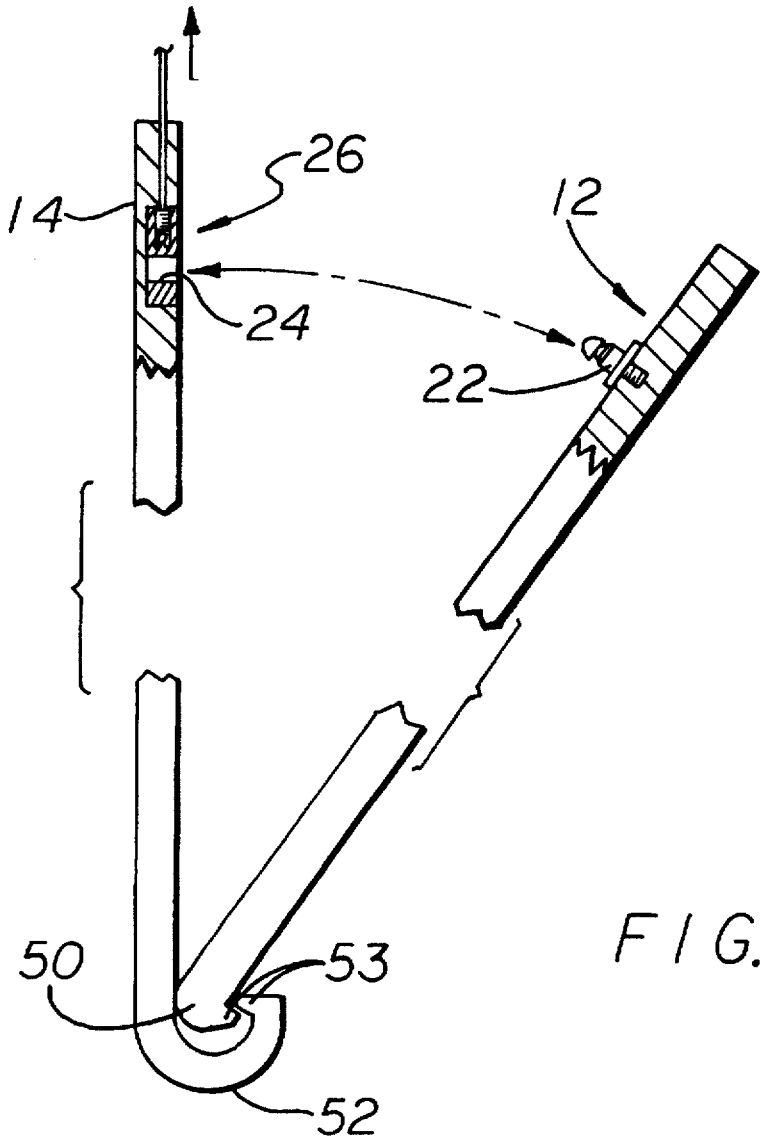
FIG. 8 is a side sectional view of the backpack being released.

As shown in FIG. 8, the first frame 12 may have a male catch 50 that is received by a female catch 52 of the second frame 14. The female catch 52 supports the first frame 12 and accompanying hardware. The catches 50 and 52 are constructed so that the first frame 12 can pivot about the second frame 14 when the pins 22 are removed from the apertures 24. The male catch 50 can be pulled out of the female catch 52 to separate the first frame 12 from the second frame 14 after being rotated to a position to disengage the lips 53 of the catches.

Figure 9:
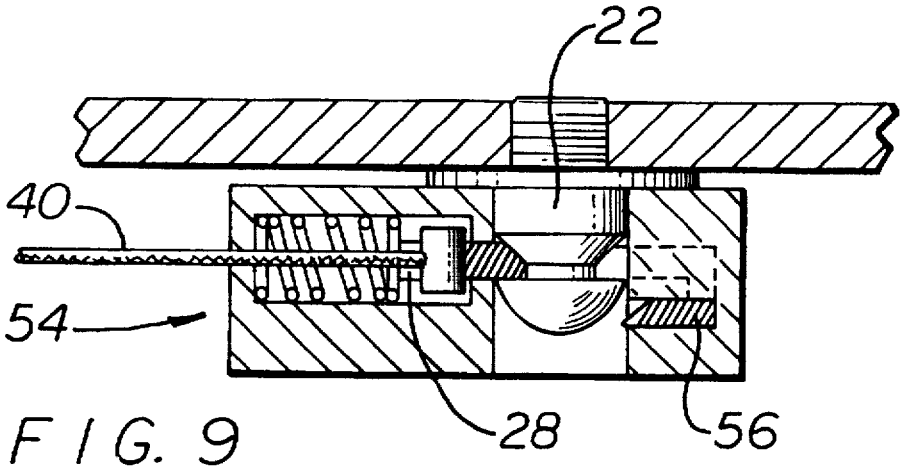
FIG. 9 is a side sectional view of an alternate embodiment of the latching mechanism.
Figure 10:
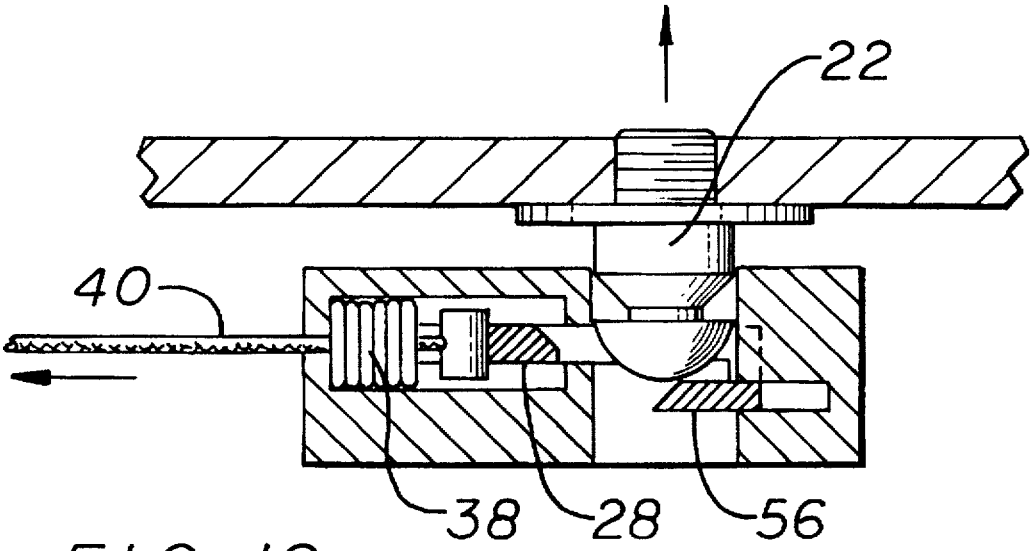
FIG. 10 is a side sectional view of the latching mechanism shown in FIG. 9 in a release position.

FIGS. 9 and 10 show an alternate embodiment of a latching mechanism 54 which has an ejector pin 56 that engages and pushes the pin 22 out of the aperture 24 when the latch rod 28 is moved to the release position. The ejector pin 56 can be coupled to the latch rod 28 to follow the movement of the rod 28.

Figure 11:
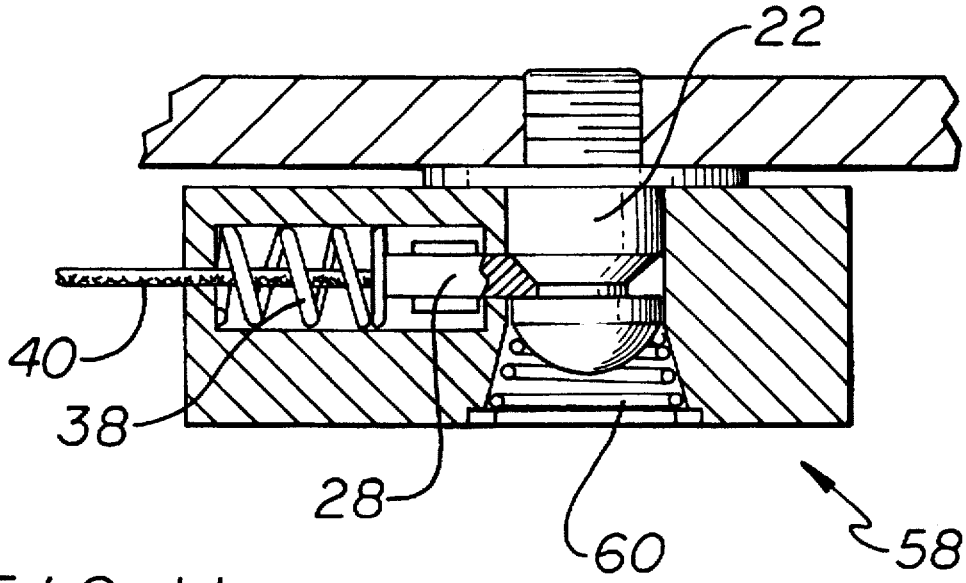
FIG. 11 is a side sectional view of a alternate embodiment of the latching mechanism.

FIG. 11 shows another alternate embodiment of a latching mechanism 58 which has an ejector spring 60 that pushes the pin 22 out of the aperture 24 when the latch rod 28 is moved to the release position.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A releasable backpack, comprising:

a first frame;

a pin attached to said first frame;

a second frame;

a latch rod that is attached to said second frame and which moves between a latch position and a release position, said latch rod engages said pin and attaches said first frame to said second frame when in the latch position; and, a release cord that is pulled to move said latch rod from the latch position to the release position, to disengage said latch rod from said pin and allow said second frame to be detached from said first frame.

2. The backpack as recited in claim 1, further comprising a spring that biases said latch rod into the latch position.

3. The backpack as recited in claim 1, further comprising a ball that is biased into engagement with a chamfered surface of said latch rod by a spring.

4. The backpack as recited in claim 1, further comprising an ejector that pushes said pin away from said latch rod when said latch rod is moved to the release position.

5. The backpack as recited in claim 4, wherein said ejector is a pin.

6. The backpack as recited in claim 4, wherein said ejector is a spring.

7. The backpack as recited in claim 1, wherein said pin has an annular groove that receives said latch rod.

8. The backpack as recited in claim 1, wherein said first frame includes a male catch that is inserted into a female catch of said second frame.

9. A releasable backpack, comprising:

a first frame that has a male catch;

a pair of pins that are attached to said first frame;

a second frame that has a female catch that receives said male catch;

a pair of latch rods that are attached to said second frame and which move between a latch position and a release position, each latch rod engages one of said pins and attaches said first frame to said second frame when in the latch position;

a pair of springs that bias said latch rods into the latch positions; and, a release cord that is pulled to move said latch rods from the latch position to the release position, to disengage said latch rods from said pins and allow said second frame to be detached from said first frame.

10. The backpack as recited in claim 9, further comprising a pair of balls that are biased into engagement with a chamfered surface of said latch rods by said spring.

11. The backpack as recited in claim 9, further comprising a pair of ejectors that push said pins away from said latch rods when said latch rods are moved to the release positions.

12. The backpack as recited in claim 11, wherein each said ejector is a pin.

13. The backpack as recited in claim 11, wherein each said ejector is a spring.

14. The backpack as recited in claim 9, wherein said pins each have an annular groove that receives said latch rods.

15. A method for detaching a backpack, comprising the steps of:

a) providing a backpack assembly which includes;

a first frame;

a pin attached to said first frame;

a second frame;

a latch rod that is attached to said second frame and which moves between a latch position and a release position, said latch rod engages said pin and attaches said first frame to said second frame when in the latch position;

a release cord that can be pulled to move said latch rod from the latch position to the release position to disengage said latch rod from said pin;

b) pulling said release cord to move said latch rod to the release position; and, c) detaching said first frame from said second frame.

* * * * *